US007416035B2

(12) United States Patent
Viswanadham et al.

(10) Patent No.: US 7,416,035 B2
(45) Date of Patent: Aug. 26, 2008

(54) SHAPED INSERTS WITH INCREASED RETENTION FORCE

(75) Inventors: Ramamurthy Viswanadham, Spring, TX (US); Lance T. Richman, Ponca City, OK (US); Chris E. Cawthorne, The Woodlands, TX (US); Anthony Griffo, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 233 days.

(21) Appl. No.: 10/917,229

(22) Filed: Aug. 12, 2004

(65) Prior Publication Data

US 2005/0067196 A1 Mar. 31, 2005

Related U.S. Application Data

(60) Provisional application No. 60/494,867, filed on Aug. 13, 2003.

(51) Int. Cl.
*E21B 10/16* (2006.01)

(52) U.S. Cl. ..... 175/374; 175/426; 76/108.4

(58) Field of Classification Search ..... 175/374, 175/425, 426; 76/108.2, 108.4
See application file for complete search history.

(56) References Cited

U.S. PATENT DOCUMENTS

| | | | | | |
|---|---|---|---|---|---|
| 3,389,761 | A | * | 6/1968 | Ott | 175/374 |
| 3,581,835 | A | | 6/1971 | Stebley | |
| 4,176,725 | A | | 12/1979 | Shields | |
| 4,211,508 | A | * | 7/1980 | Dill et al. | 407/120 |
| 4,361,196 | A | * | 11/1982 | Hoyle, Jr. | 175/320 |
| 4,423,646 | A | * | 1/1984 | Bernhardt | 76/108.1 |
| 4,540,596 | A | * | 9/1985 | Nimmagadda | 427/534 |
| 4,696,352 | A | | 9/1987 | Buljan et al. | |
| 4,782,903 | A | | 11/1988 | Strange | |
| 5,131,481 | A | * | 7/1992 | Smith | 175/428 |
| 5,159,857 | A | * | 11/1992 | Jurewicz | 76/108.2 |
| 5,174,396 | A | * | 12/1992 | Taylor et al. | 175/420.1 |
| 5,423,719 | A | * | 6/1995 | Jennings | 451/540 |
| 5,499,688 | A | | 3/1996 | Dennis | |
| 5,678,645 | A | | 10/1997 | Tibbitts et al. | |
| 5,833,021 | A | * | 11/1998 | Mensa-Wilmot et al. | 175/433 |

(Continued)

FOREIGN PATENT DOCUMENTS

| | | |
|---|---|---|
| EP | 0083287 | 7/1983 |

(Continued)

OTHER PUBLICATIONS

Canadian Official Action issued in Application No. 2477673 and dated Apr. 3, 2006 (4 pages).

(Continued)

*Primary Examiner*—Kenneth Thompson
(74) *Attorney, Agent, or Firm*—Osha Liang LLP

(57) ABSTRACT

A shaped insert that includes a top portion, and a grip length, wherein the grip length is modified to have a non-uniform cross sectional area is disclosed. In another case, a shaped insert includes a top portion, and a grip length, wherein the grip length is modified such that the insert is non-cylindrical. In another case, a shaped insert includes a top portion, and a grip length, wherein the grip length is coated in a non-uniform manner.

30 Claims, 7 Drawing Sheets

U.S. PATENT DOCUMENTS

| | | | | |
|---|---|---|---|---|
| 5,845,384 | A * | 12/1998 | Retzbach | 29/450 |
| 6,068,072 | A | 5/2000 | Besson et al. | |
| 6,105,694 | A * | 8/2000 | Scott | 175/428 |
| 6,799,648 | B2 * | 10/2004 | Brandenberg et al. | 175/420 |
| 6,908,688 | B1 * | 6/2005 | Majagi et al. | 428/552 |

FOREIGN PATENT DOCUMENTS

| | | |
|---|---|---|
| EP | 0101096 | 2/1984 |
| EP | 0151537 | 8/1985 |
| EP | 0169718 | 1/1986 |
| GB | 2311084 | 9/1997 |
| WO | WO 00/50729 | 8/2000 |

OTHER PUBLICATIONS

Examiner's First Report issued in patent Application No. 2004205106 dated Apr. 12, 2006 (3 pages).

* cited by examiner

SHAPED INSERTS WITH INCREASED RETENTION FORCE

CROSS-REFERENCE TO RELATED APPLICATIONS

This application claims benefit to U.S. Provisional Application Ser. No. 60/494,867, filed Aug. 13, 2003. This provisional application is hereby incorporated by reference in its entirety.

BACKGROUND OF INVENTION

1. Field of the Invention

The invention relates generally to methods and apparatus for providing inserts for use in roller cone drill bits that have improved properties when compared with prior art inserts.

2. Background Art

Drilling in the earth is commonly accomplished by using a drill bit having a plurality of rock bit roller cones ("cutter cones") that are set at angles relative to the drill string axis. The bit essentially crushes the formations through which it drills. The roller cones rotate on their axes and are, in turn, rotated about the main axis of the drill string. In drilling boreholes for oil and gas wells, blast holes, and raise holes, rock bit roller cones constantly operate in a highly abrasive environment. This abrasive condition exists during drilling operations even with the use of a medium for cooling, circulating, and flushing the borehole. Such a cooling medium may be either drilling mud, air, or another liquid or gas.

One type of commonly used rock bit contains a plurality of inserts ("cutting elements") which are press-fit into the body of the cone. These inserts may be formed from a variety of materials, such as tungsten carbide, or other hard materials. The inserts are retained in "cutter pockets" (holes in the cone body) by the interference between the walls of the cutter pocket and the sides of the insert.

The inserts are subjected to a number of different forces that cause the inserts to be forcibly ejected from the insert pockets. One solution, therefore, to increasing drill bit life is to increase the amount of force required to push an insert from an insert pocket.

Other traditional methods for improving the "push out force" include increasing the size of the insert, relative to the pocket (to increase the interference), or conversely, decreasing the size of the pocket. However, such prior art methods have inherent limitations, because as the size of the pocket is decreased, or the cutter size is increased, at some point cone cracking, or yielding of the area around the cutter pocket occurs.

As used herein, the "push out force" is a measure of the force required to physically displace the insert from a selected position. Those having ordinary skill in the art will recognize that the push out force may be measured in a number of different ways, and no limitation on the scope of the invention is intended by the discussion provided below.

FIG. 1 illustrates a typical prior art rock bit for drilling boreholes. The rock bit 10 has a steel body 20 with threads 14 formed at an upper end and three legs 22 at a lower end. Each of the three rolling cones 16 are rotatably mounted on a leg 22 at the lower end of the body 20. A plurality of cemented tungsten carbide inserts 18 are press-fitted or interference fitted into insert sockets formed in the cones 16.

When in use, the rock bit is threaded onto the lower end of a drill string (not shown) and lowered into a well or borehole. The drill string is rotated by a rig rotary table with the carbide inserts in the cones engaging the bottom and side of the borehole 25 as shown in FIG. 2. As the bit rotates, the cones 16 rotate on the bearing journals 19 and essentially roll around the bottom of the borehole 25. The weight on the bit is applied to the rock formation by the inserts 18 and the rock is crushed and chipped by the inserts. A drilling fluid is pumped through the drill string to the bit and is ejected through nozzles 26 (shown in FIG. 1). The drilling fluid then travels up the annulus formed between the exterior of the drill pipe and the borehole 25 wall, carrying with it most of the cuttings and chips. In addition, the drilling fluid serves to cool and clean the cutting end of the bit as it works in the borehole 25.

FIG. 2 shows the lower portion of the leg 22 which supports a journal bearing 19. A plurality of cone retention balls ("locking balls") 21 and roller bearings 12*a* and 12*b* surround the journal 19. An O-ring 28, located within an O-ring groove 23, seals the bearing assembly.

The cone includes multiple rows of inserts, and has a heel portion 17 located between the gage row inserts 15 and the O-ring groove 23. A plurality of protruding heel row inserts 30 are about equally spaced around the heel 17. The heel row inserts 30 and the gage row inserts 15 act together to cut the gage diameter of the borehole 25. The inner row inserts 18 generally are arranged in concentric rows and they serve to crush and chip the earthen formation.

What is needed therefore, are methods and apparatus for improving the working life of drill bits.

SUMMARY OF INVENTION

In one aspect, the present invention relates to a shaped insert that includes a top portion, and a grip length, wherein the grip length is modified to have a non-uniform cross sectional area.

In one aspect, the present invention relates to a shaped insert including a top portion, and a grip length, wherein the grip length is modified such that the insert is non-cylindrical.

Other aspects and advantages of the invention will be apparent from the following description and the appended claims.

DETAILED DESCRIPTION

The present invention relates to apparatus and methods for increasing the working life of a drill bit. In particular, embodiments of the present invention relate to inserts having improved retention properties when compared to prior art inserts. In one aspect, therefore, the present invention relates to inserts that require a higher retention force to be displaced from a pocket as compared to prior art inserts. As used herein, the term non-uniform means somewhere along length of insert there is a geometric change.

One method of computing the "push out force" is to determine the interfacial pressure on the insert due to the interference fit. The interfacial pressure due to the interference fit can be calculated using the following formula for compound cylinders:

$$p = \delta / D_c \left\{ \frac{(G + \nu_s)}{E_s} + \frac{(1 - \nu_c)}{E_c} \right\} \quad \text{[Eq. 1]}$$

where p is the interface pressure;

δ is the interference fit on the diameter;

$D_c$ is the diameter of the insert;

$D_s$ is the diameter of the steel;

$E_s$ and $E_c$ are Young's moduli of the steel and insert, respectively;

$\nu_s$ and $\nu_c$ are Poisson's ratios for the steel and insert, respectively;

and G is a geometric factor=$(D^2_s+D^2_c)/(D^2_s-D^2_c)$.

This method assumes that the insert has a cylindrical shape. This is a good approximation for most inserts, which are typically designed to have a cylindrical geometry.

Embodiments of the present invention provide a surprising increase over the theoretically computed interface pressure. Accordingly, embodiments of the present invention provide inserts having an increased push out force, which leads to the creation of more durable bits. Further, embodiments of the present invention relate to inserts for use in rock bit applications. As used herein, the term "rock bit" expressly includes roller cone bits, fixed cutter bits, or any other type of bit for cutting through earth formations. Also as used herein, the term non-circular is intended to include the term non-cylindrical. As used herein, the term insert is not intended to be limited to an insert for a roller cone bit but is generally used to refer to any cutting element to be inserted into a cutting tool, such as a cutter inserted into a fixed cutter bit.

Figure 1:
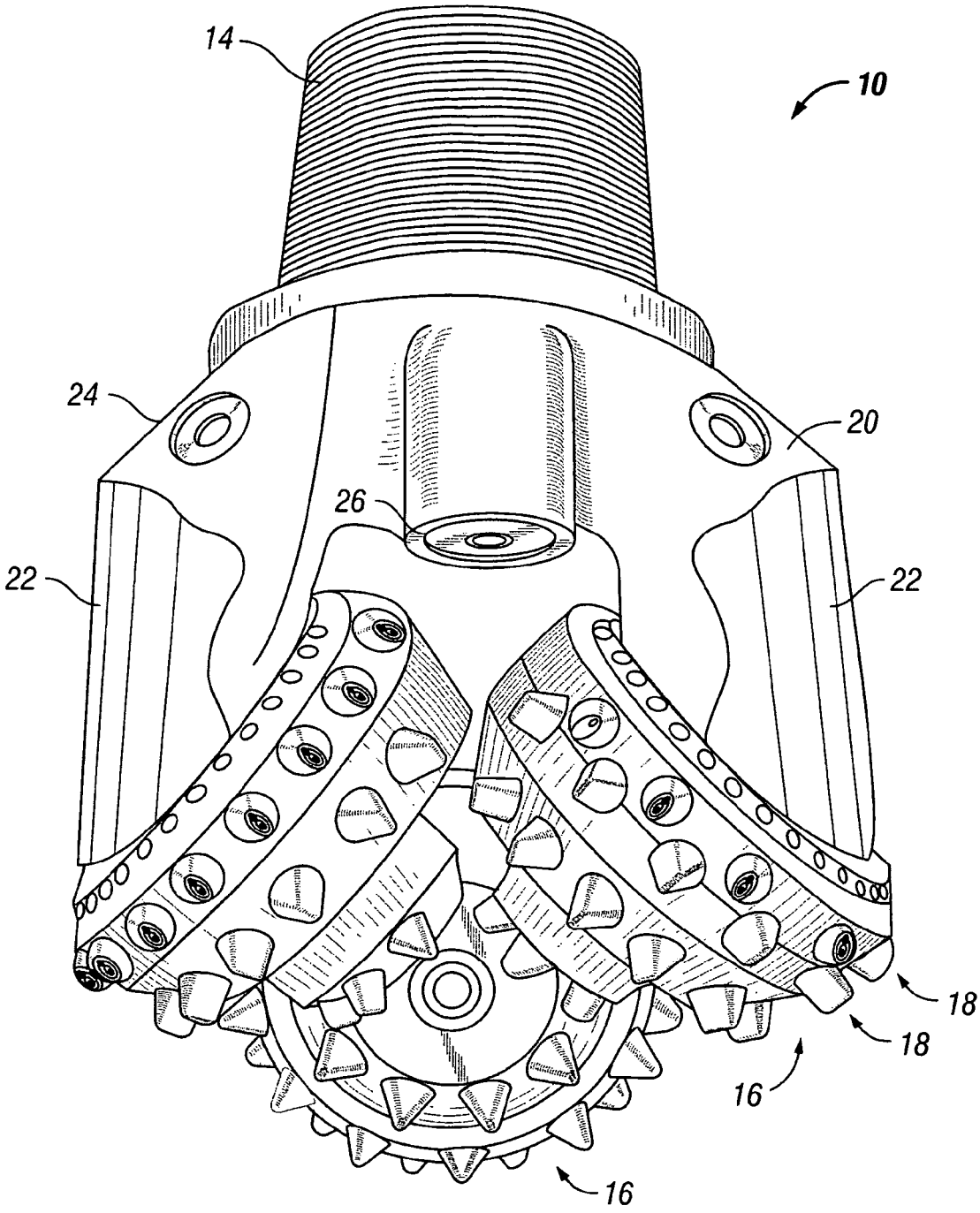
FIG. 1 (Prior Art)
FIG. 1 shows a prior art roller cone drill bit.
Figure 2:
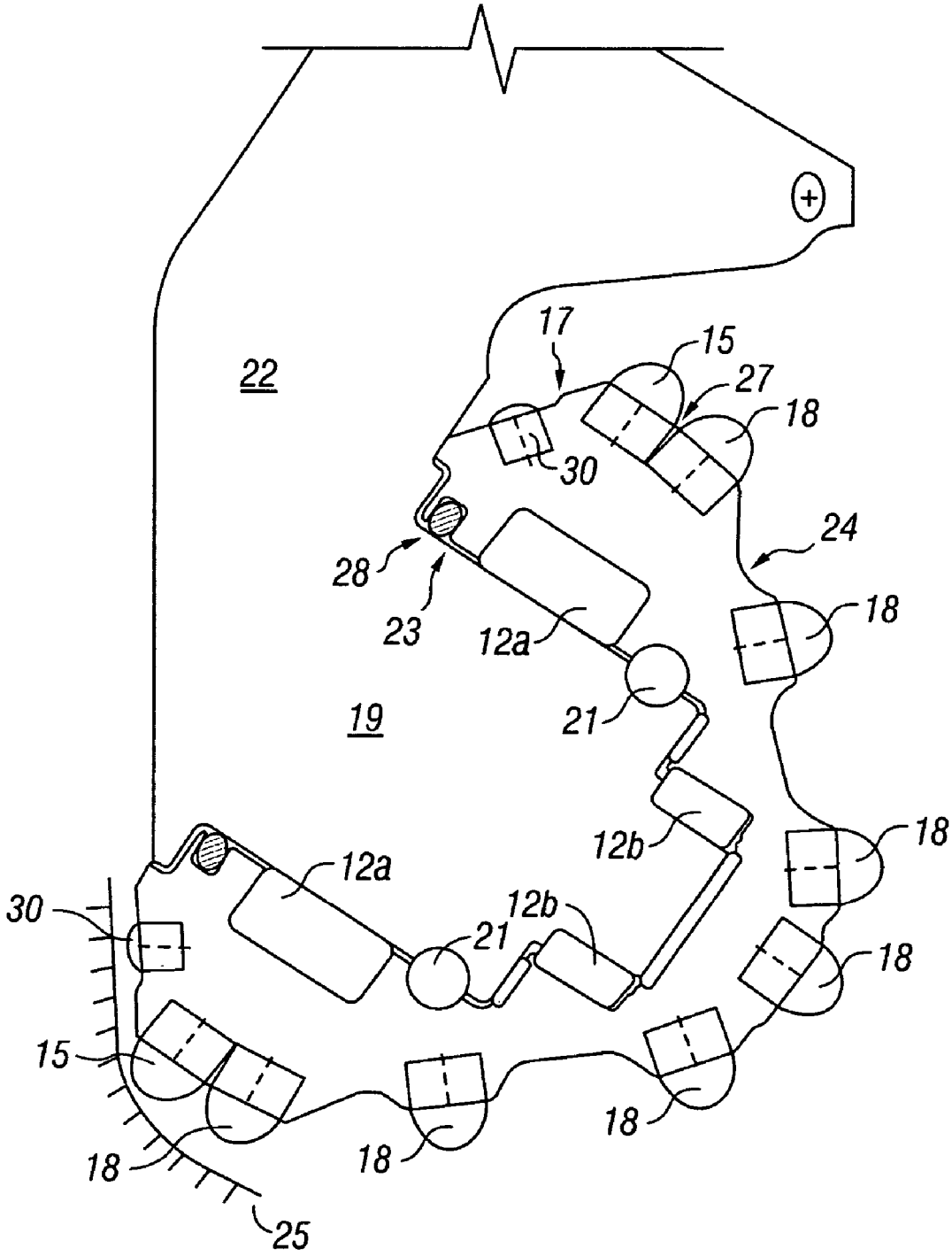
FIG. 2 (Prior Art)
FIG. 2 shows a cross-sectional view of one leg of the roller cone drill bit shown in FIG. 1.
Figure 3A:
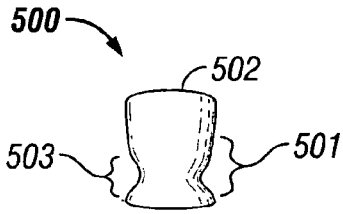
FIGS. 3*a*-3*c* illustrate shaped inserts in accordance with an embodiment of the present invention.
Figure 3B:
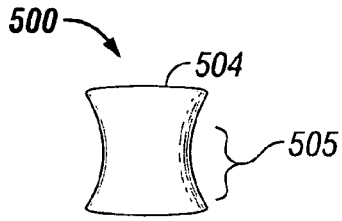

FIGS. 3*a*-3*b* illustrate shaped inserts in accordance with one aspect of the present invention. In FIG. 3*a*, an insert 502 having a generally cylindrical shape is shown. However, the insert 502 has been milled in a selected manner, such that the insert contains at least one grip region 503 having a reduced cross-sectional area. The cross section is along a direction from the top to the bottom of the insert. Providing a reduced cross-sectional area in at least one region has been discovered to provide a dramatic increase in the push out force required to remove the insert from an insert pocket. In a preferred embodiment, the grip length section 501 of the insert is altered in order to make the insert non-cylindrical.

Without limiting the scope of the invention, the mechanism for this increase in retention strength is believed to be the following. Because the inserts have a larger diameter than the insert pocket, when pressed (under an applied force) into the insert pocket, the walls of the pocket expand slightly to allow the insert to fit. Once the applied force is released, the walls of the pocket contract. It is believed that when using inserts in accordance with the present invention, the walls of the pocket will "flow" into contact with the reduced cross-sectional area of the insert.

Figure 3C:
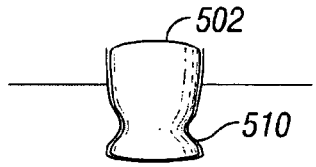

This process is shown diagrammatically in FIGS. 3*a* and 3*c*. In FIG. 3*a*, an insert 502 is shown. The insert 502 has a top portion 500 which actually engages the formation being drilled. Further, the insert has a "grip length" 501, which is the portion of the insert that extends into an insert pocket. Those having ordinary skill in the art will recognize that the term grip length has a well defined meaning within the mining industry. As used herein, the term "grip region" is used to mean at least a portion of the grip length. The grip region may extend over the entire grip length or over portions thereof. Thus, when the term grip region is used, it is intended to cover a finite portion (which may be all) of the grip length.

Moreover, the insert 502 is shown having an area 503 that has a reduced cross-sectional area along at least a portion of the grip length 501 when compared with the areas immediately above and below. In FIG. 3*c*, the insert 502 is shown in an insert pocket 510. As shown in FIG. 3*c*, the walls of the insert pocket 510 have expanded to contact the sides of the insert 502. FIG. 3*b* illustrates a variation, where the insert 504 is milled to have a relatively constant radius of curvature. No limitation on the scope of the invention is intended by reference to the geometric shapes shown in the Figures. A number of other geometries, which may be symmetric or asymmetric may be used.

These embodiments have variable diameters, preferably along grip length regions. In a preferred embodiment, the insert has a variable diameter along the grip length such that the insert appears like an hour glass. After the insert is pressed into a pocket, the steel wall of the pocket expands back into the concavity of the hourglass shape and creates a mechanical lock. It should be noted, however, that other insert shapes other than those shown are expressly within the scope of the present invention. The modification to the grip length (to create a non-uniform cross section and/or to render the insert non-cylindrical) may be accomplished through a number of different insert geometries, which may or may not be symmetrical.

Figure 4:
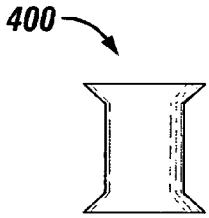
FIG. 4 shows a shaped insert in accordance with an embodiment of the present invention.

FIG. 4 illustrates another embodiment of the present invention, wherein a shaped insert (400) has linear indentations along the grip length, rather than curved portions.

Figure 5:
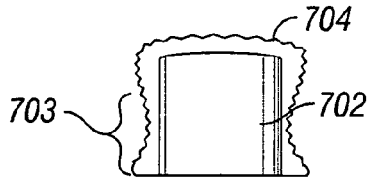
FIG. 5 illustrates a shaped coating on an insert in accordance with an embodiment of the present invention.

FIG. 5 illustrates an embodiment of the present invention that incorporates a coating and the reduced cross-sectional area (described with reference to FIGS. 3*a*-3*c*). In particular, FIG. 5 shows an insert 702, having a grip length 703, and having a coating 704, wherein the coating is applied to the grip length 703 in a manner so as to achieve the increase in push out force described with reference to FIG. 3*a*-3*c* above. In the embodiment shown, the coating 704 is applied to have a generally hourglass shaped appearance. A number of different coatings may be applied to provide different material properties to the insert 702.

Those of ordinary skill in the art will recognize that a number of coatings, so long as they have sufficient hardness and durability, may be used. In preferred embodiments, the coating is a boride, nitride, or carbide of a group IVA, VA, or VI transition metal (Ti, Zr, Hf, V, Nb, Ta, Cr, Mo, W), or mixtures thereof. Most preferably, the coating is TiN. The coating may be applied over both the grip length and the working area (top face) of the insert, or may be applied only to the grip length. Again, the coating may be applied in any suitable fashion and/or geometry.

In a preferred embodiment, physical vapor deposition (PVD) was used to apply a TiN coating to an insert. In this embodiment, the TiN coating was applied to achieve a coating approximately 5 μm thick. The coated inserts were then press-fit into a test cone. Those having ordinary skill in the art will appreciate that the thickness of the coating is not intended to limit the scope of the present invention. Embodiments of the present invention are expressly intended to include thicknesses of 1 μm and above. In selected embodiments, a thickness of 2 μm is used.

In addition, because the insert itself does not have to be milled, the advantages associated with the non-uniform cross-sectional area discussed above may be realized in an easier manufacturing process. Again, no limitation on the scope of the invention is intended by the specific geometry shown in FIG. 5.

Figure 6:
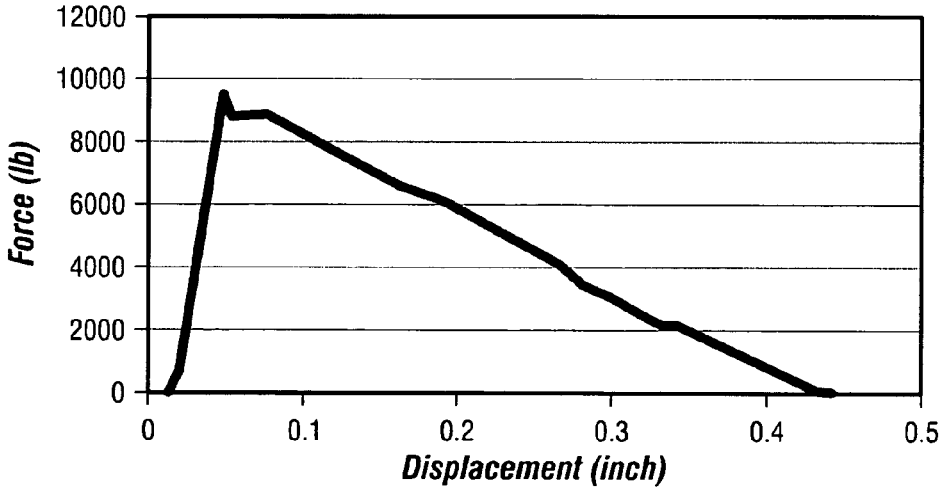
FIGS. 6-8 provide push out force vs. displacement curves for "standard" inserts.
Figure 7:
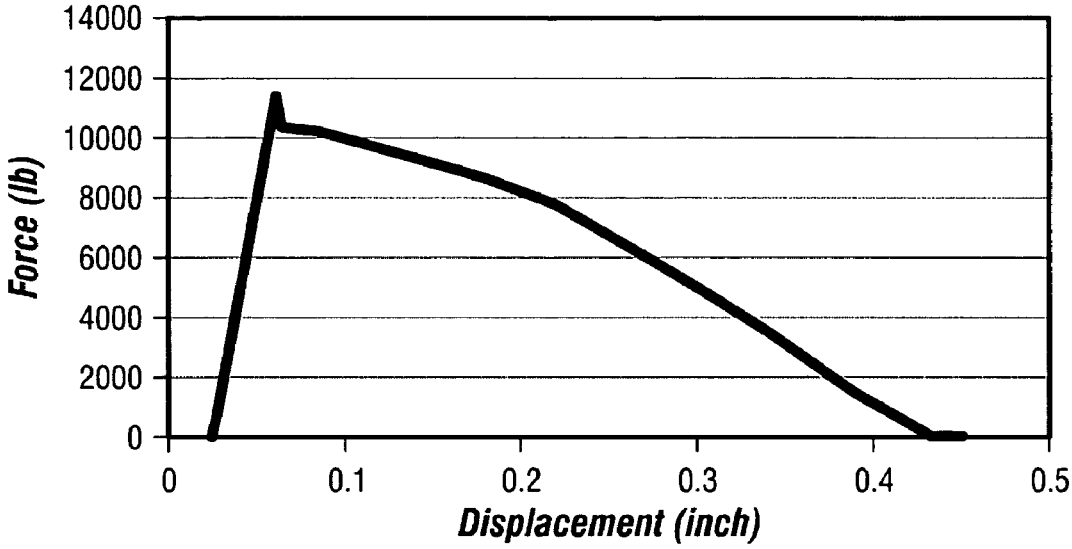
Figure 8:
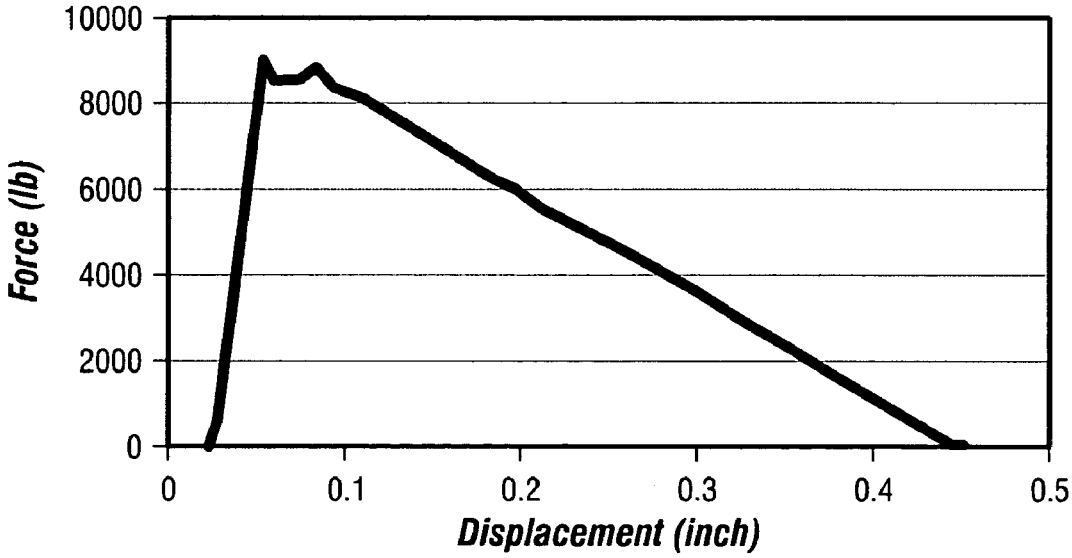
Figure 9:
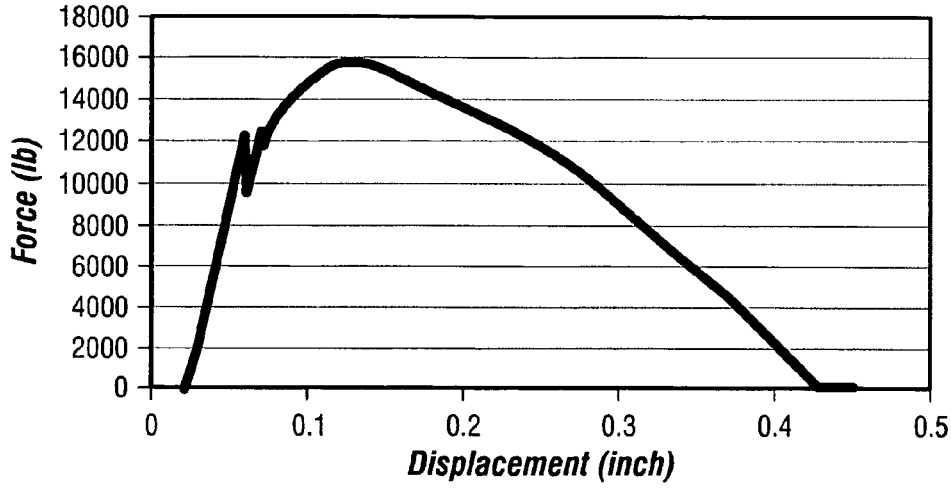
FIGS. 9-11 provide push out force vs. displacement curves for "modified" inserts in accordance with an embodiment of the present invention.
Figure 10:
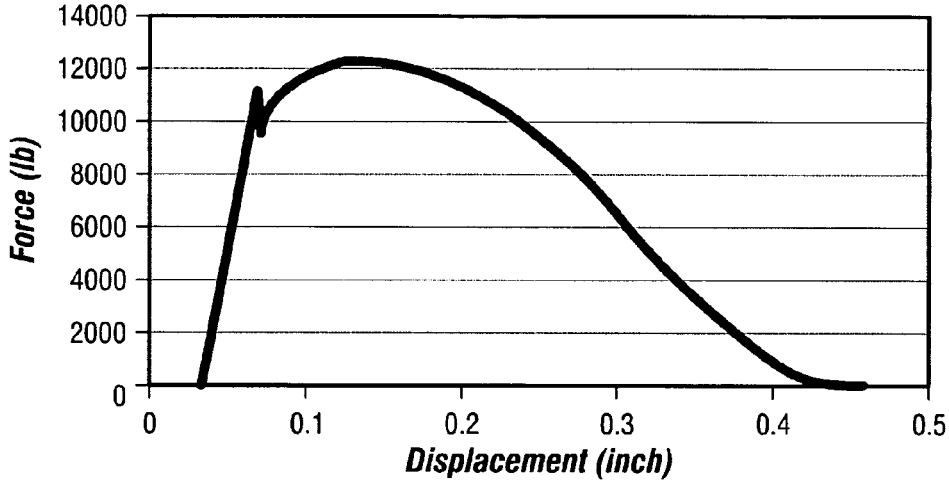
Figure 11:
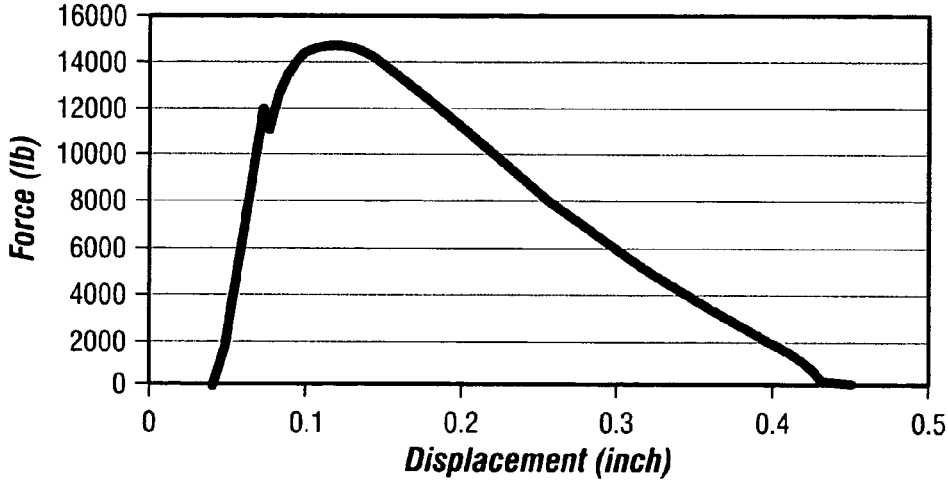

FIGS. 6-11 illustrate the improvement in push-out force that may be achieved by providing a coated insert having at least a portion with a reduced cross-sectional area. For comparison, three standard inserts, which have a substantially cylindrical appearance and are uncoated, were tested to determine the push-out force required to remove the insert from a test fixture. The results are shown in FIGS. 6-8. Three modified inserts, which have reduced diameter sections and are coated with TiN were also similarly tested. The results from the coated inserts are shown in FIGS. 9-11. A description of the testing procedure follows.

Figure 12:
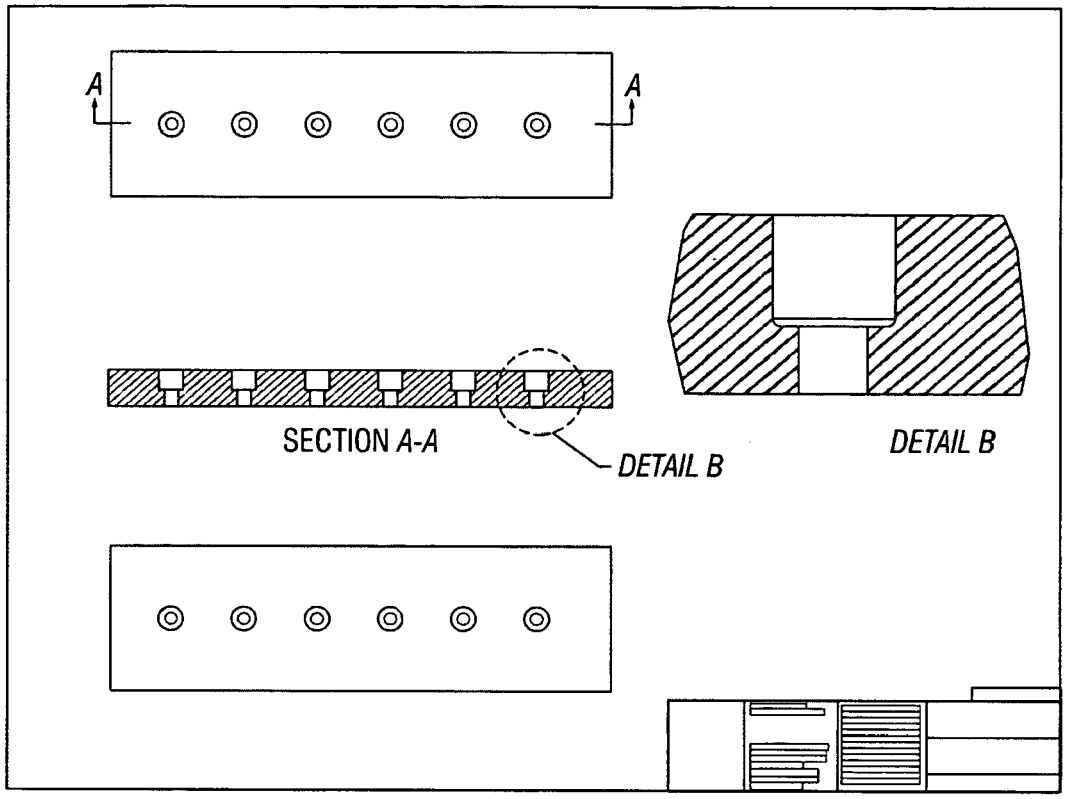
FIG. 12 illustrates a test fixture used in order to determine the push out force vs. displacement curves shown in FIGS. 6-11.
Figure 13:
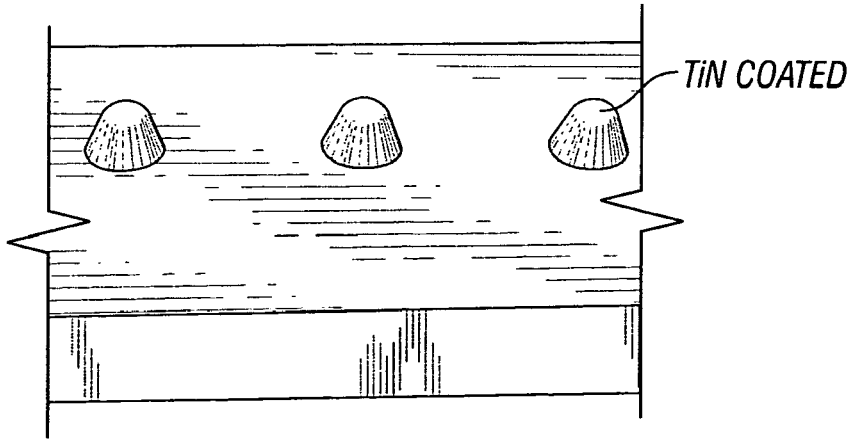
FIG. 13 shows another view of the test fixture of FIG. 12.
Figure 14:
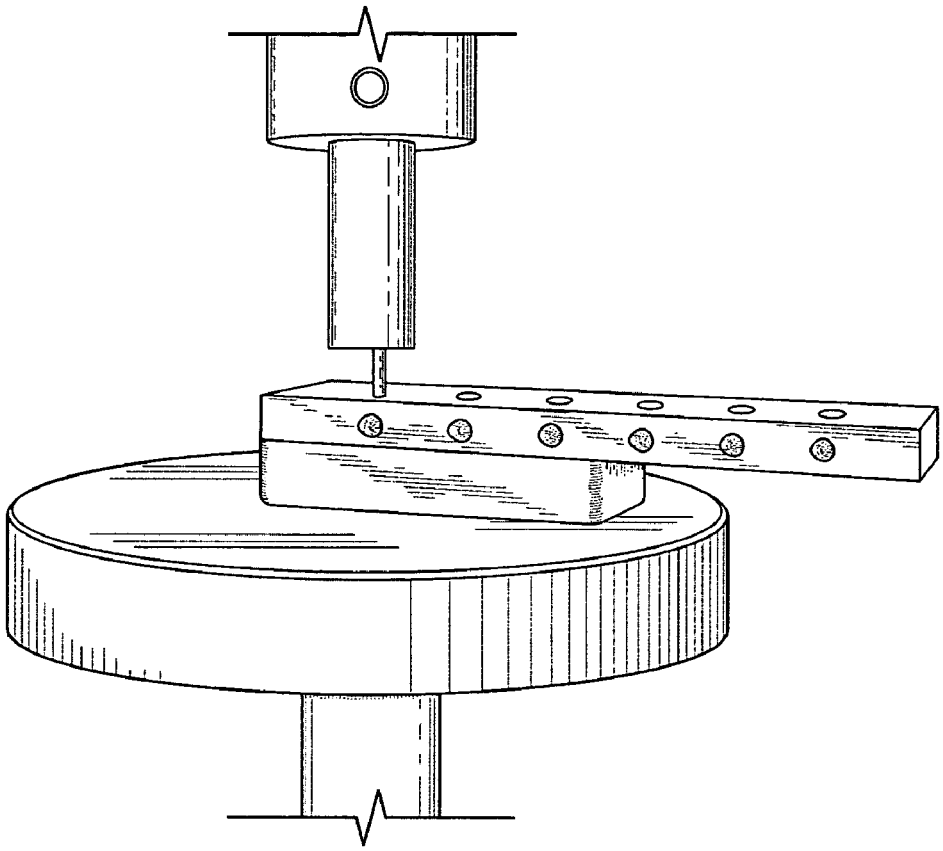
FIG. 14 shows a view of the test set up for determining the push out force vs. displacement curves shown in FIGS. 6-11.

Six 0.5 inch diameter holes were drilled into a test plate fabricated from 9313 steel, which had been previously heat treated to a hardness of about 40 HRC. Smaller (approximately 0.28 inch in diameter) holes were drilled on the bottom for pushing the inserts out. Three standard and three modified (TiN coated) inserts having a nominal interference fit and an average retention length of 0.440 inches were pressed alternately into these holes. The test fixture and test setup are shown in FIGS. 12-14. An MTS servo hydraulic system was used to push the inserts out and the force vs. displacement curves were measured. The maximum force (the "push out force") is used as a measure of insert retention.

As noted above, the push out force vs. displacement curves for the standard (uncoated) and modified (coated) inserts are shown in FIGS. 6-11. As can be seen from the Figures, the force displacement curves within each group are similar. In contrast, the force displacement curves between the two groups are very different. The curves for the standard inserts (FIGS. 6-8) show a linear increase to a maximum, followed by a short plateau and then a linear decrease. The force displacement curves for the modified insert, however, are both qualitatively and quantitatively different. They show an increase to a maximum followed by a short drop and then a nonlinear increase to a higher maximum. The decrease from the maximum is also nonlinear.

Table 1 below provides a summary of the maximum loads measured during push out of the modified (coated) and standard (uncoated) inserts.

| Insert ID | Maximum Load (lb) |
|---|---|
| Standard 1 | 9540 |
| Standard 2 | 11450 |
| Standard 3 | 8983 |
| Standard Average | 9991 |
| Modified 1 | 15843 |
| Modified 2 | 12474 |
| Modified 3 | 14833 |
| Modified Average | 14383 |

As shown in Table 1 above, the average maximum force for the standard inserts is 9991 lbs, while the average maximum force for the modified inserts is 14,383 lbs, which is an increase of approximately 44%. Some of this increase would be expected due to the increased diametrical interference of the modified inserts. That is, because the inserts have a 5 μm thick coating, the modified inserts have approximately a 10 μm thick increase in interference.

The average diametrical interference for the uncoated inserts was determined to be 96.5 μm. The expected increase in push out force for the coated inserts is about 10% (based on the theory that a 10% increase in diametrical interference would provide a 10% increase in push out force). The 44% increase is unexpected because the TiN coating is expected to reduce the friction coefficient.

Using typical material and dimensional parameters in equation (1) for the interface pressure set forth above, the theoretical (calculated) interfacial pressure is 112,542 psi. The area of the cylindrical portion of the insert, as tested, is 0.6912 square inches. Therefore, the retention force is 77,789 lb. For a typical friction coefficient of about 0.1 to 0.15, the push out force will be 7,779 to 11,668 lbs. As can be seen from Table 1, the measured forces for the uncoated inserts correlate well with the calculated values.

Those having ordinary skill in the art will appreciate that embodiments of the present invention may also be used to increase a selected inserts resistance to rotation within the pocket. That is, embodiments of the present invention provide inserts having a larger resistance to rotation (i.e., circular turning) within the pocket. This feature may be particularly advantageous for inserts having an oriented top portion. As those having ordinary skill will appreciate, for certain applications, it is desirable to orient inserts such that the inserts have a selected angle of attack on a formation.

In prior art rock bits, however, the inserts may rotate within the pocket causing them to lose the selected orientation, which may, for example reduce drilling effectiveness. By providing increasing resistance to an increased resistance to rotation, therefore, the orientation of the inserts may be more securely maintained for a longer period of time, resulting in improved performance. However, this feature is not limited to inserts having a selected orientation, as preventing free rotation within the pocket is also believed to provide increased insert life, even for those inserts that do not have an orientation.

Figure 15A:
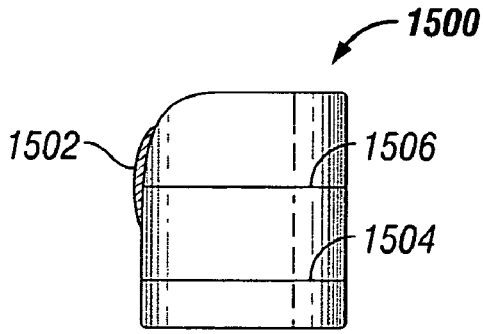
FIGS. 15*a* and *b* show an insert in accordance with an embodiment of the present invention.
Figure 15B:
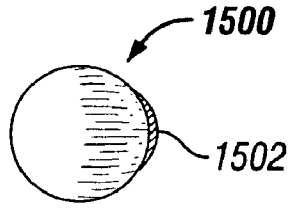

FIGS. 15*a* and 15*b* illustrate one such embodiment. In FIG. 15*a*, an insert 1500 is shown. As explained above, typical prior art inserts have substantially circular lateral cross-sectional areas. In FIG. 15*a*, the insert 1500 contains (at 1504) one such area. However, the structure of the insert 1500 in FIG. 15 has been modified in this embodiment to include a non-circular (or non-uniform) region 1506, by means of increasing the coating on a selected region of the insert 1500 (shown as 1502). In this manner, when the insert 1500 is pressed into a circular pocket (not shown), the difference in radial geometry between the two regions 1504, 1506 makes the insert 1500 resistant to rotation. As explained above, increasing the torque force required to rotate an insert in a pocket may lead to a reduced risk of the insert being forced out of the pocket.

FIG. 15*b* shows another view (looking from the top) of insert 1500. In particular, the top of insert 1500 is shown, with a producing portion 1502 jutting off of one side of the insert 1500.

While reference has been made to adding material to a selected region of the insert in order to improve torque resistance. Those of ordinary skill in the art will appreciate that material may be removed from the insert in order to achieve the same effect. Further, those having ordinary skill will recognize that the cross-section of the insert may be formed in a non-circular geometry to achieve an improved torque resistance. In particular, a hexagonal insert geometry may be used, for example. Again, those having ordinary skill in the art will appreciate that a number of non-circular geometries may be used in order to create the increased torque resistance, and the scope of the present invention is not intended to be limited to any particular one.

Further, while reference has been made to modifying existing inserts, those of ordinary skill in the art will recognize that embodiments of the present invention are equally applicable to forming shaped inserts. In other words, embodiments of the present invention specifically include methods of manufacturing inserts having the shaped described above, without starting from prior art insert structures. Thus, in one embodiment, for example, the present invention relates to a method of forming an insert that comprises providing, during the forming process, a non-circular cross-sectional area along a grip length, which comprises part of a grip portion.

Thus, embodiments of the present invention, by providing an insert coating, significantly increase the insert push out force. In addition, other embodiments of the present invention relate to a shaped insert having a geometric shape selected to enhance the insert's push out force. One of ordinary skill in the art would appreciate that it is possible to combine the shaping and coating on the same insert to produce inserts having increased push out forces.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting tool comprising:

at least one roller cone; and at least one shaped insert inserted into at least one substantially uniform socket in the at least one roller cone, wherein the at least one shaped insert comprises:

a top portion;

bottom portion; and a grip length between the top portion and the bottom portion, wherein the grip length comprises a grip region having a reduced non-uniform cross sectional area along at least a portion of the grip length when compared with areas immediate above and below.

2. The cutting tool of claim 1, wherein the cross-sectional area of the grip region is non-uniform through the deposition of a coating.

3. The cutting tool of claim 2, wherein the coating comprises at least one selected from the group consisting of a boride, a nitride, and a carbide of a group IVA, VA, or VI transition metal (Ti, Zr, Hf, V, Nb, Ta, Cr, Mo, W).

4. The cutting tool of claim 2, wherein the coating is titanium nitride.

5. The cutting tool of claim 2, wherein the coating is deposited on the insert by physical vapor deposition.

6. The cutting tool of claim 1, wherein material has been removed from the grip region to decrease the cross-sectional area of the grip region.

7. A cutting tool comprising:

at least one roller cone; and at least one shaped insert inserted into at least one socket in the at least one roller cone, wherein the at least one shaped insert comprises:

a top portion; and a cylindrical grip length, comprising a grip region, wherein the grip region is modified such that the insert is non-circular in a cross-section at a point between cylindrical portions immediately above and below the modified grip region.

8. The cutting tool of claim 7, wherein the cross-sectional area of the grip region is decreased.

9. The cutting tool of claim 7, wherein the grip region comprises a constant radius of curvature.

10. The cutting tool of claim 7, wherein the modification comprises adding a coating to the insert.

11. The cutting tool of claim 10, wherein the coating comprises at least one selected from the group consisting of a boride, a nitride, and a carbide of a group IVA, VA, or VI transition metal (Ti, Zr, Hf, V, Nb, Ta, Cr, Mo, W).

12. The cutting tool of claim 11, wherein the coating is titanium nitride.

13. The cutting tool of claim 10, wherein the coating is deposited on the insert by physical vapor deposition.

14. The cutting tool of claim 7, wherein material has been removed from the grip region in order to form a non-circular grip region.

15. A cutting tool comprising:

at least one roller cone; and at least one insert inserted into at least one socket in the at least one roller cone, wherein the at least one insert comprises:

a top portion; and a grip length, comprising a grip region wherein the grip region is coated in a non-uniform manner.

16. The cutting tool of claim 15, wherein a coating comprises at least one selected from the group consisting of a boride, a nitride, and a carbide of a group IVA, VA, or VI transition metal (Ti, Zr, Hf, V, Nb, Ta, Cr, Mo, W).

17. The cutting tool of claim 16, wherein the coating is titanium nitride.

18. The cutting tool of claim 17, wherein the titanium nitride is deposited on the insert by physical vapor deposition.

19. The cutting tool of claim 15, wherein the cross-sectional area of the coated grip region is decreased over at least a portion of the grip region.

20. The cutting tool of claim 18, wherein the grip region of the coated insert is non-circular.

21. A method of forming a cutting tool, comprising:

forming an insert comprising a top portion and a grip length, the grip length comprising a grip region;

coating the grip region in a non-uniform manner, wherein a coating comprises at least one selected from the group consisting of a boride, a nitride, and a carbide of a group WA, VA, or VI transition metal (Ti, Zr, Hf, V, Nb, Ta, Cr, Mo, W; and inserting the shaped insert into a substantially uniform pocket of a roller cone.

22. The method of claim 21, wherein the non-uniform coating is titanium nitride.

23. The method of claim 22, further comprising depositing the titanium nitride on the insert by physical vapor deposition.

24. The method of claim 21 wherein the insert pocket is substantially cylindrical.

25. A method of forming a cutting tool, comprising:

forming a substantially cylindrical insert comprising a top portion, a bottom portion, and a grip length between the top portion and the bottom portion, the grip length comprising a grip region;

modifying the grip region to have a reduced non-uniform cross-sectional area along at least a portion of the grip length when compared with areas immediate above and below; and inserting the modified insert into an insert pocket of a roller cone.

26. The method of claim 25, wherein the modifying the grip region comprises depositing a coating on the grip region.

27. The method of claim 26, wherein the coating comprises at least one selected from the group consisting of a boride, a nitride, and a carbide of a group IVA, VA, or VI transition metal (Ti, Zr, Hf, V, Nb, Ta, Cr, Mo, W).

28. The method of claim 27, wherein the coating is titanium nitride.

29. The method of claim 26, further comprising depositing the titanium nitride on the insert by physical vapor deposition.

30. The method of claim 26, wherein the insert pocket is substantially cylindrical.

* * * * *

UNITED STATES PATENT AND TRADEMARK OFFICE

CERTIFICATE OF CORRECTION

PATENT NO. : 7,416,035 B2
APPLICATION NO. : 10/917229
DATED : August 26, 2008
INVENTOR(S) : Ramamurthy K. Viswanadham et al.

It is certified that error appears in the above-identified patent and that said Letters Patent is hereby corrected as shown below:

In Claim 1, column 7, line 44, before the word "bottom" the word "a" is missing.

In Claim 21, column 8, line 52, "WA" should be --IVA--.

Signed and Sealed this

Eleventh Day of November, 2008

JON W. DUDAS
*Director of the United States Patent and Trademark Office*